United States Patent [19]

Sciortino

[11] 4,177,920

[45] Dec. 11, 1979

[54] SELF-LOCKING COIN RECEPTACLE AND COVER THEREFOR

[76] Inventor: August M. Sciortino, 1919A Pickwick La., Glenview, Ill. 60025

[21] Appl. No.: 868,876

[22] Filed: Jan. 12, 1978

[51] Int. Cl.[2] ..... G07B 15/00

[52] U.S. Cl. ..... 232/16

[58] Field of Search ..... 232/15, 16, 31, 32, 232/1

[56] References Cited

U.S. PATENT DOCUMENTS

| | | | |
|---|---|---|---|
| 351,011 | 10/1886 | Wherry et al. | 232/16 |
| 368,502 | 8/1887 | Wherry | 232/16 |
| 2,973,139 | 2/1961 | Leone et al. | 232/15 |
| 3,741,464 | 6/1973 | Verbeke | 232/16 |
| 3,807,627 | 4/1974 | Nitschneider | 232/15 |
| 3,837,566 | 9/1974 | McGough | 232/15 |
| 3,843,043 | 10/1974 | Sciortino | 232/15 |
| 3,926,366 | 12/1975 | Sciortino | 232/16 |

*Primary Examiner*—Roy D. Frazier

*Assistant Examiner*—Peter A. Aschenbrenner

*Attorney, Agent, or Firm*—Silverman, Cass & Singer, Ltd.

[57] ABSTRACT

A self-locking coin receptacle and cover therefor for use in coin-controlled machines. In one embodiment described herein the cover is formed of two parts, the first being a rectangular open-bottom channeled member open at one end and a second channeled member carrying an open topped flexible bag and said second member adapted slidably to receive said first member. The first member has a window and a narrow longitudinal slot opening to the window. A spring biased slide within said first member operates to cover and uncover the window. A spring catch mechanism is described for operation between a condition permitting uncovering of the window and a latched condition closing off access. A detent prevents removal of the box from the receptacle unless the window is covered fully.

A cover suitable for use on a coin box is described also.

23 Claims, 24 Drawing Figures

SELF-LOCKING COIN RECEPTACLE AND COVER THEREFOR

BACKGROUND OF THE INVENTION

This invention relates generally to locking covers for coin containers of the type used with coin-controlled machines.

More particularly, the invention is directed to the provision of a self-locking cover for such containers, the cover having spring catch means installed therein to prevent non-detectable tampering with the container by servicemen or others during the period between removal from the coin-controlled machine and deposit at an authorized counting station.

Vending machines operated by coins normally have coin containers such as coin boxes or similar receptacles to receive the coins dropped into the machine by those who have purchased merchandise from the machines. Such coin containers are locked into prefabricated recesses provided in the machines. When the machine is serviced, the serviceman removes the loaded coin container, empties it and replaces it within the recess.

For security purposes it has become customary to have a coin container which is locked, and remains locked until it is returned to the proprietor of the vending machine or to an authorized station whereat it can be opened and the coins removed. In such cases, the serviceman is provided with an empty, locked container so that when the loaded container is removed from the enclosure, a fresh, empty container replacement can be installed.

In order to prevent pilferage from the coin container subsequent to removal from the machine, the serviceman is not given keys thereto. Accordingly, the container must have a mechanism to meet the following conditions.

The coin container must be in condition to receive the coins when the serviceman installs the same within the enclosure provided in the machine. Normally there is a window in the top of the coin box which must be opened on installation and remain open after the box is installed, the window being aligned with the delivery end of the coin chute of the machine. This window must be closed at all times when the container is outside the enclosure. When the serviceman removes the loaded container, his act of removal must close the window, lock it in closed condition and must thwart any attempts to gain access to the interior thereof for the surreptitious removal of coins therefrom.

Apparatus of the general type is known; reference may be made to U.S. Pat. Nos. 2,973,139; 1,685,219; 2,580,752 as well as to Applicant's prior U.S. Pat. Nos. 3,797,735 and 3,843,043.

A significant cash loss from vending machine collections still remains a persistent problem to which much attention presently is directed. Some proposed solutions are without sufficient economic feasibility to gain wide acceptance. One source of loss involves internal cash security in view of the numerous individuals who handle the coin boxes including route men, handling the particular installations, route supervisors, mechanical supervisors, internal auditing personnel and others. Inevitably, no matter how many locks, tamperproof devices, etc. are installed, the very strength of the temptation for undetected pilfering gives rise, in a clever and/or unscrupulous individual, to ingenious means for "beating" the protective devices which have been provided. Although the provision of a machine that is "unbeatable" probably is not possible, the provision of means to effect positive detection of tampering, if tampered, to provide identification of the fact and possibly the culprit is highly desirable.

Prevention of undetectable, surreptitious entry to the coin containers whether prior to installation in a machine, during and in the period subsequent to removal thereof by the serviceman until deposit of the locked boxes in secure areas with those who are empowered to open the boxes and tall the content thereof is a very important goal.

In view of the individuality of many of the coin-controlled machines and substantial difference in construction between machines of different manufacturers, another important criteria which must be met by any proposed protective devices in order to gain acceptance, in addition to being "tamperproof", is that the device be capable for use with different machines without major fitting adjustments, be easily transportable with security, relatively simple to construct, to assemble for the serviceman to install and others to handle opening, resetting and locking. The structure must render non-detactable tampering highly improbable and, at best, should be provided with some type means to prevent unauthorized access thereto even while installed within the machine.

Of course, minimization of the total number of required parts lead to reduction in cost and complexity of manufacture and assembly. Accordingly, proposed solutions to the problem of undetected tampering, etc. should meet such criteria.

Much attention also has been directed to providing locked coin bags for use in vending machines. Of advantage is the ease of transport with security since the loaded bag will be receivable in drum type safes or other secure repositories with minimum bulk space requirement. Thus, the self-locking cover should be suitable for use with coin bags as well as boxes.

Structure also should be provided to enable the locked coin receptable to be unloaded, removed from the vending machine, transported with security, unlocked, unloaded, reset and readied for installation with minimum complexity and time lapse.

Also advantageous would be the provision of means whereby the act of installation by the serviceman must be completed, so that if interrupted, completion would be prevented and a new locked receptacle would be required.

BRIEF SUMMARY OF THE INVENTION

The invention provides a self-locking cover assembly for a coin container. The cover includes a first channel member open at one end. A slide assembly is arranged in the channel. A second channel member carrying a flexible coin bag is capable of receiving the first channel member to complete the cover assembly. A window is formed in the top wall of the first channel member. The window is located to enable alignment with the delivery end of the coin chute of the coin-controlled machine when the bag and locked cover assembly is installed fully into the machine. The slide assembly is movable during entry into the enclosure between a condition whereat the window is blocked to a condition in which the window is open. Means are provided to maintain the open condition subsequent to installation and to retain the open condition thereof while the container remains installed. Means also are provided whereby during and subsequent to the withdrawal of the coin box from the enclosure, the window is blocked and access may not be gained thereto by covert or surrepititious action. In particular, spring biased catch means are employed so that once the locked covered container is installed within the designated enclosure, the locked assembly cannot be withdrawn unless the window is closed off. Once the container is withdrawn, the window cannot be uncovered covertly without detection. Means also are provided to prevent withdrawal of the locked container from the enclosure area while the window is uncovered. In addition, a removable coupling is provided between the bag and the second channel member of the cover, including a collar and a tamperproof assembly over the open end of the bag thereto.

The cover of the invention is capable, with minor modification, of use with a coin box of the type widely utilized with prefabricated enclosures of vending machines.

DESCRIPTION OF PREFERRED EMBODIMENTS

Figures 1, 2, 2A, 2B:
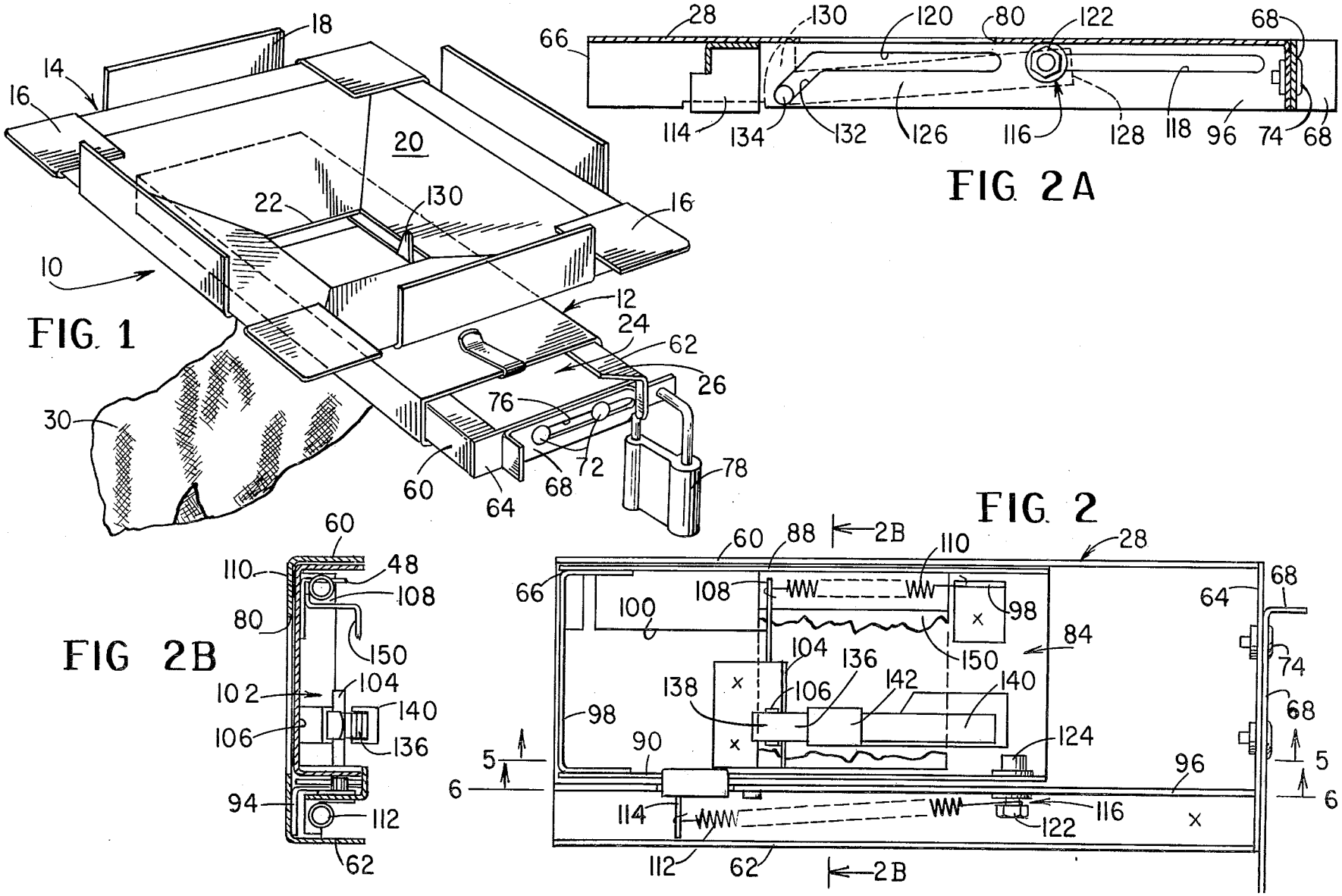
FIG. 1 is a perspective view, looking downward, of a locked covered coin receptacle according to the invention as installed in a preformed bracket capable of being secured within an enclosure formed in a coin-controlled machine.
FIG. 2 is a bottom plan view of one member of the self-locking cover of the invention that is illustrated in FIG. 1.
FIG. 2A is a section taken along line 2A—2A of FIG. 2.
FIG. 2B is a transverse section taken along line 2B—2B of FIG. 2.
Figure 3:
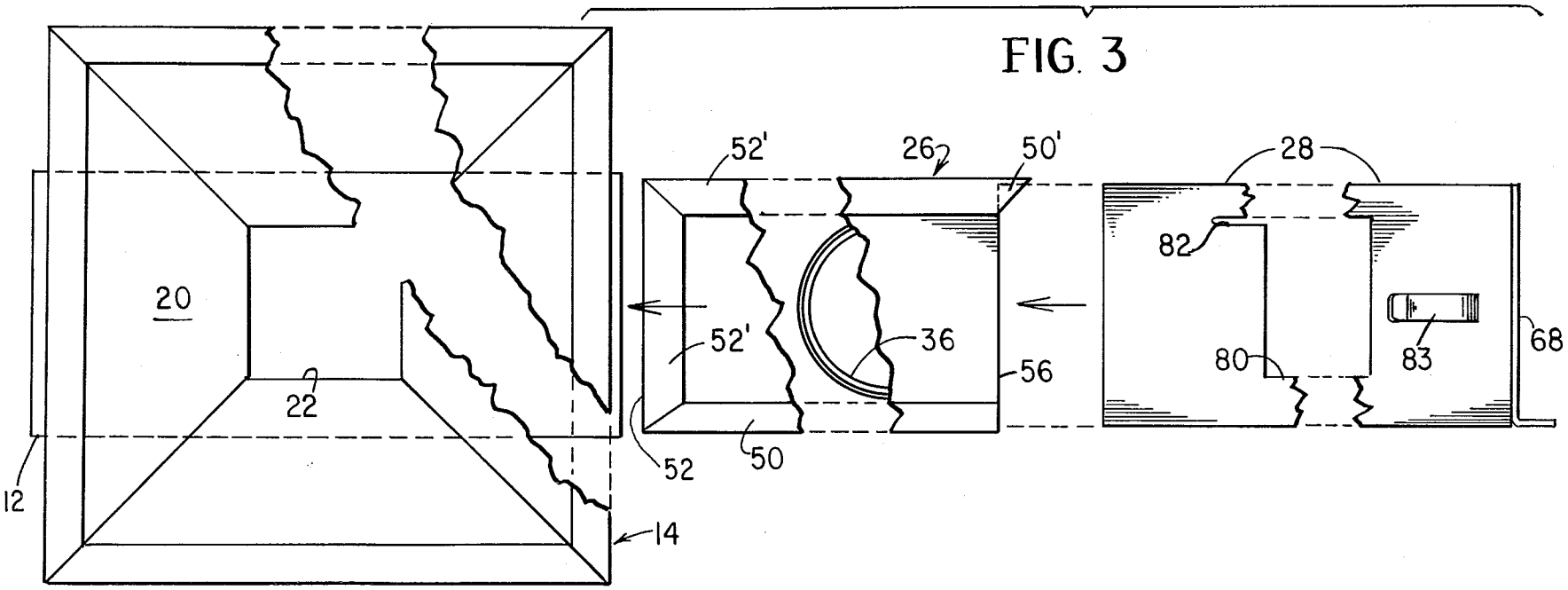
FIG. 3 is an exploded fragmentary top plan view, portions being deleted, illustrating process of assembling the arrangement illustrated in FIG. 1.
Figure 4:
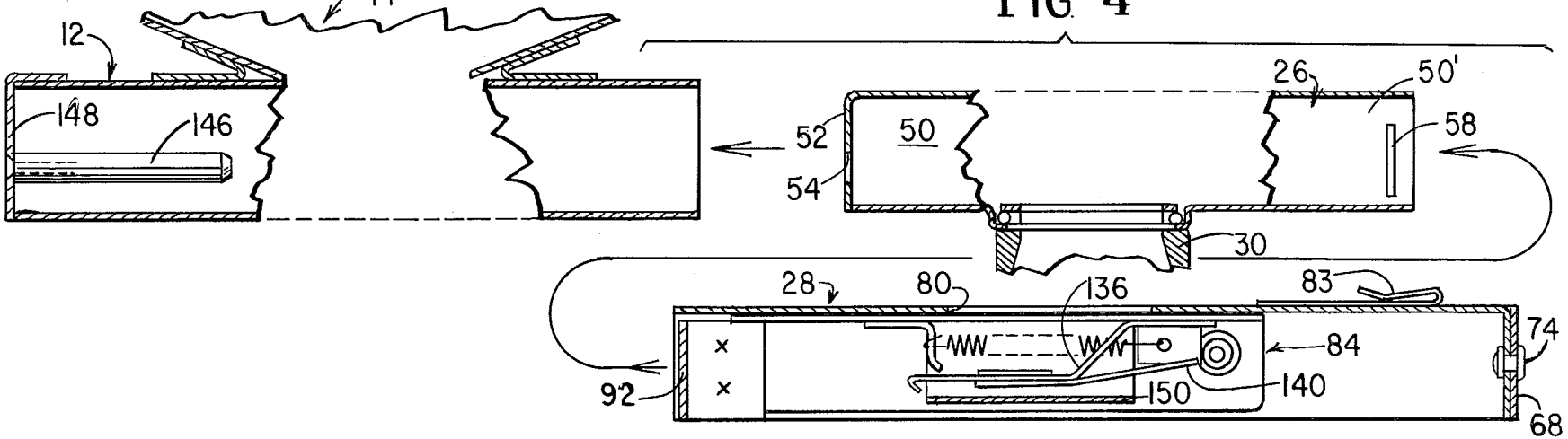
FIG. 4 is an exploded fragmentary sectional view of the tlements illustrated in FIG. 3.
Figure 5:
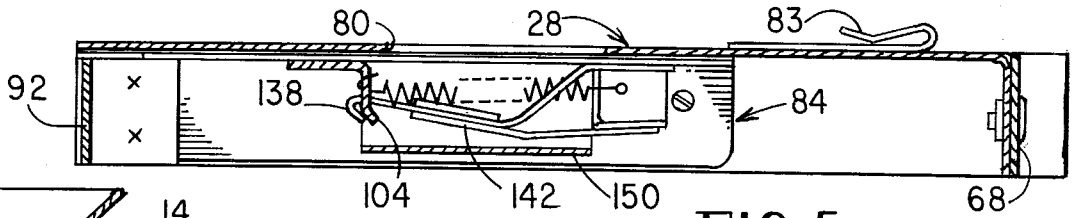
FIG. 5 is a sectional view taken along line 5—5 of FIG. 2 but with the cover illustrated in locked condition assumed subsequent to removal of the covered bag from the enclosure.

Briefly, the invention is directed to the provision of a self-locking cover for a coin container for coin-controlled machines.

A first, preferred embodiment of the invention shall be described as applied in a cover installed on a coin container formed of a flexible bag is illustrated in FIGS. 1 to 8.

A second embodiment described hereinafter illustrates the cover according to the invention as installed on a rigid coin box and is illustrated in FIGS. 9 to 21A and 21B.

The flexible bag coin container has the cover of the invention slidably received within a bracket coupled to a coin funnel installed interior of the conventional enclosure into which coins, introduced by purchasers, pass from the delivery end of an internal coin chute of the coin-controlled machine. The cover includes an access window and provides means for selectively uncovering the window and maintaining the window open when installed, and covering the window automatically during withdrawal of the container.

The cover of the invention includes detent means effective to prevent withdrawal of the covered container from the coin-controlled machine unless the access window of the cover is blocked. The cover of the invention also provides spring biased catch means serving to prevent uncovering of the access window subsequent to withdrawal of the cover and bag assembly from the coin-controlled machine and prevents unauthorized tampering or pilfering without detection by maintaining said window covered, positively preventing uncovering thereof by servicemen or others during transit to authorized stations where authorized personnel can unlock and remove the cover.

The cover according to the invention requires only minor modification for application to the rigid coin box structures.

Referring first to FIGS. 1 through 8, the invention will be described first as embodied in a coin-receiving bag which has particular advantage in minimizing storage space during transit.

The locked, covered flexible coin bag 10 is illustrated as installed within a channel-shaped bracket 12 which is in turn secured to a coin funnel 14, the same being constructed for installation in coin-controlled machines originating with different manufacturers so as to enable the locked covered flexible bag 10 to be employed. The available coin-controlled machines primarily differ as to their coin handling and delivery functions by the location of the delivery end of the coin-receiving chute thereof at various and different areas of a prefabricated coin collector enclosure or housing. Heretofore, such differences required coin-receiving articles having entry openings so located particularly directly to receive the coins specifically for each machine, many requiring much "retrofit" construction. Such adjustments are unnecessary or greatly minimized with use of the invention.

The funnel 14 is provided with corner tabs 16 and side tabs 18 enabling securement at different mounting locations within a coin-receiving housing (not shown). Regardless where the coin chute delivery is located, the coins will land onto one of the tapered walls 20 of funnel 14 and be directed to the bottom opening 22 thereof.

Referring now to the illustrated locked, covered coin container 10, same has a cover 24 formed of a pair of channeled members 26 and 28 of generally rectangular configuration, and a flexible, open-topped bag 30 formed of plastic or cloth material secured onto one of said members.

Figure 7:
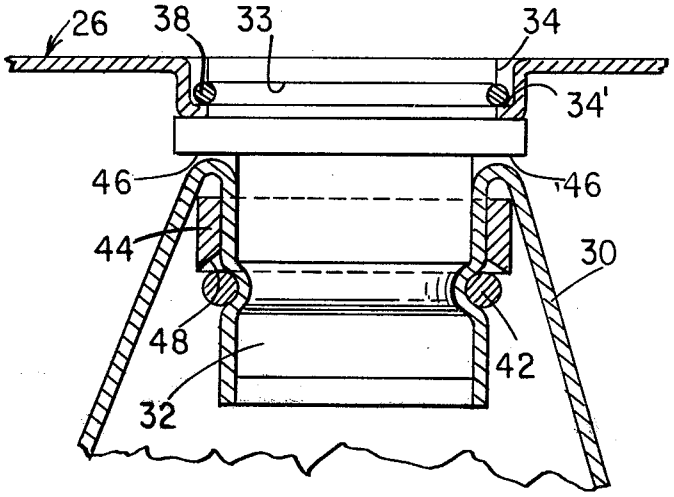
FIG. 7 is a fragmentary enlarged detail of a portion of FIG. 6 illustrating the bag assembly and its mounting to the cover.
Figure 6:
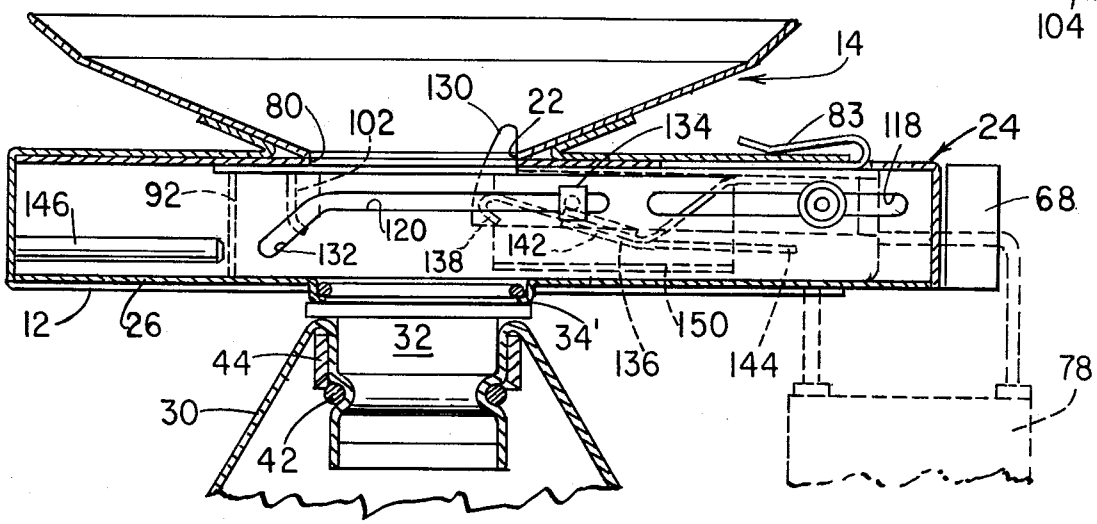
FIG. 6 is a sectional view taken along lines 6—6 of FIG. 1 and in the direction indicated.

Referring to FIG. 7, the bag 30 is provided with a collar 32. The collar 32 has an undercut rim 34 adapted to be received within the circular rimmed opening 36 formed in the member 26. The opening 36 is located for alignment with the bottom opening 22 of the funnel 14 when the coin container 10 is installed within channeled bracket 12. The rim 34 is locked in place by a split retaining ring 38 seated on rim 34' surrounding opening 36 and within circumferential groove 33 formed on rim 34 defining a swivel coupling.

The bag 30 is secured to the collar 32 so as to resist separation when installed. The collar 32 has a circumferential groove 40, and is placed within the upper open end of the bag 30. A split retaining ring 42 is spread slightly, fitted over the open end of the bag 30 and released to seat within the groove 40 sandwiching the bag 30 therebetween. A flat security ring 44 is seated tightly about the bag 30 above the ring 42. The bag 30 then is draped over the flat security ring 44. When the collared bag is secured to the cover portion 26, an annular passage 46 is defined between said member 26 and the security ring 44, through which is passed the open end of the bag 30. The lower end of security ring 44 is beveled as at 48. If the installed bag 30 is pulled away, say by one endeavoring forcibly to separate bag 30 and the cover 24, the beveled portion 48 bears against the retaining ring 42, causing the same to drive the bag material deeper into the groove 40, reinforcing the coupling between the bag 30 and collar 32.

Referring now back to FIGS. 2 to 6 inclusive, the cover portion 26 includes a pair of parallel side walls 50 and an end wall 52, the same having an aperture 54 formed therein. The side and end walls 50 and 52 have right angle flanges 50' and 52'. The opposite end 56 of portion 26 is open. One of the side walls 50 has an extension tab 50' which carries a rectangular slot 58, the purpose of which will become apparent hereinafter.

The cover portion 28 holds the operating mechanisms of the cover 22 and includes a pair of parallel side walls 60 and 62, end wall 64 and opens at its opposite end 66. A slotted latch 68 is secured to the end wall 64 through its slot 70 by a pair of rivets 72, the heads 74 being spaced from the end wall 64 to enable movement of latch 68 slidably into and out from slot 58 when the pair of cover members 26 and 28 are assembled. The latch 68 also carries an aperture 76 located at the free end thereof. A plastic locking seal 78 is passed through aperture 76 after the latch 68 is manipulated through slot 58. Once seal 78 is applied and locked, it must be severed to remove and gain access to the interior of assembly 10.

The cover portion 28 has a window 80 formed as a cutout, as well as a longitudinal slot 82 opening to one corner of window 80. A return bent spring clip 83 opening to the open end of the cover portion 28 fixedly is secured thereto, said clip 83 serving as a stop and retainer when the cover 10 is introduced into the bracket 12.

a spring biased slide assembly 84 is arranged within the cover portion 28 for covering and uncovering the window 80. The slide assembly includes a flat plate 86 having a pair of parallel side walls 88, 90 and an end bridge wall 92. An L-shaped member 94 having upstanding wall 96 fixedly is secured to cover portion 28 alongside wall 62 to place wall 96 spaced from and parallel to said wall 62. Apertured tab 98 is secured onto the plate 86 near wall 88 thereof. The plate 86 is provided with a cutout 100 so that when moved to the right, as viewed in FIG. 2, for example, along member 28, the window 80 is uncovered. An upstanding wall 102 is secured to cover portion 28 along window 80, a portion 104 of the upper edge thereof being beveled to define a camming surface. A passage 106 is formed in wall 102 below the portion 104 thereof. An apertured tab 108 extends parallel to wall 102. An expansion spring 110 is coupled between tabs 98 and 108. A second expansion spring 112 is connected to tab 114 (which is secured to wall 96) and to pivot coupling 116. First and second elongate longitudinal slots 118 and 120 are provided in wall 96.

Slot 118 is straight and accommodates the coupling formed of bolt 122 passing therethrough, secured in place by nut 124 secured to wall 90 of slide 84. A flat plate 126 is disposed sandwiched between walls 90 and 102, and pivotally mounted to bolt 122 at one end 128. The opposite end of plate 126 is formed as a hook-shaped formation 130. The slot 120 has an arcuate end portion 132. A follower 134 is passed through slot 120 and secured to formation 130. So long as follower 134 rides in the straight portion of slot 120, the hooked formation 130 is urged outward of the cover portion 28 through window 80. At the portion 132, the follower 134 is cammed to cause formation 130 to withdraw from window 80.

Figure 8:
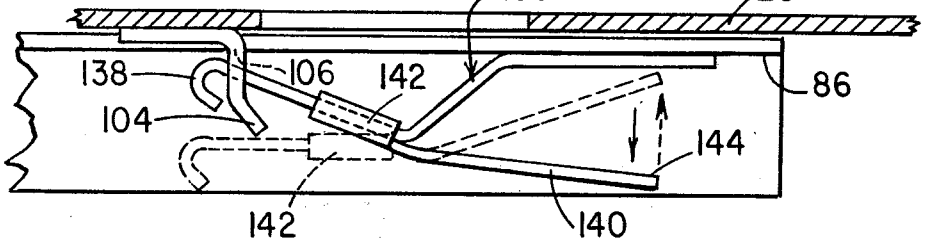
FIG. 8 is an enlarged fragmentary detail illustrating the spring catch means installed on the cover according to the invention.

Referring to FIG. 8, a flat spring 136 is secured to plate 86 at one end, cantilevered toward the beveled portion 104 of wall 102. The free end of spring 136 carries unitary claw 138 which is capable of either riding the portion 104 or being cammed thereby to pass through passage 106 so that the claw 138 is released to engage portion 104 to prevent return passage of the spring 136 and hence, the slide 84 is prevented from being manipulated in reverse to uncover window 80.

Lever arm 140 is secured to spring 136, arms 142 sandwiching said spring. Lifting end portion 144 of arm 140 causes the claw 138 to be depressed below portion 104. If simultaneously, the slide assembly 84 is urged to the right, the claw 138 is non-interferent with such motion.

Then, when the claw 138 is clear of portion 104, the portion 144 of lever 140 is urged toward portion 86 lifting the claw 138 above portion 104 and the slide 84 returned to its normal condition biased with the window 80 covered. Now the spring catch means of the invention has been reset or cocked and cover portion 28 is in condition for assembly with portion 26 and together the cover assembly 24 is ready for introduction to the bracket 12 for installation.

For the purpose of this application, the wall portions 102 and 104 with passage 106 together can be referred to as a loop or loop defining means and wall 92 can be referred to as a pusher since it functions as a pusher cooperable with structure provided in the machine housing, such as pusher or plunger bar 146 secured to end wall 148 of bracket 12. When the assembled locked covered bag 10, with the spring 136 in cocked or in primed condition, is slidably received in bracket 12, the free end of bar 146 passes through aperture 76 to engage wall 92 of the slide assembly 84. The slide assembly 84 then is urged against the bias of springs 110 and 112 fully to uncover the window 80. Claw 138 drops off wall portion 104. The hooked formation 130 is cammed through slot 82 to enter window 80 and hence be positioned in the opening 22 of funnel 24 in interferent relation to reverse movement of the covered bag 10 with the said window in open condition from the bracket 12, as shown in FIG. 1.

The cover 24 is pushed into the channeled bracket 12 until stopped by the leading edge 148 thereof engaged within spring clip 83. The spring clip 83 has sufficient strength to overcome, together with the frictional resistance of cover 24 within bracket 12, the bias of springs 110 and 112 which could otherwise urge the cover 24 from said bracket. The window 80 is maintained uncovered. When the cover 22 is grasped, say with simultaneous grasping of clip 83, the slide 84 is released, to return to its normal condition, i.e., window 80 covered, under the bias of springs 110 and 112. Simultaneously, the formation 130 is cammed out of interferent relation and within the cover 24. If one attempted to retain the window 80 open or even partially open, removal of the covered bag 10 from bracket 12 would not be possible. Since the formation 130 fully is retracted into the cover 24, access thereto is not possible without damage or leaving traces of such tampering.

The claw 138 is passed through passage 106 and thus acts to prevent movement of slide assembly 84 to the right until the spring 136 is reset subsequent to authorized opening of the container 10.

As shown in FIG. 1, the locked coin container 10 can be serviced by a serviceman. The serviceman has been supplied with locked empty bags by his employer. The installed container 10 is withdrawn from the bracket 12, automatically resulting in operation of the slide assembly 84 to cover the window 80. A fresh locked covered bag 10 with the spring 136 reset, slidably is installed in the bracket 12.

The container 10 which has been removed then is placed in a secure receptacle, such as a tumble or rotary safe. Any attempt to gain access to the content of the container by the serviceman or other unauthorized personnel will result in visible evidence of such attempt-surreptitious tampering being impossible without detection.

A shield 150 may be installed, if desired, on the slide 84 over the spring 136 to afford even more protection.

Figure 9:
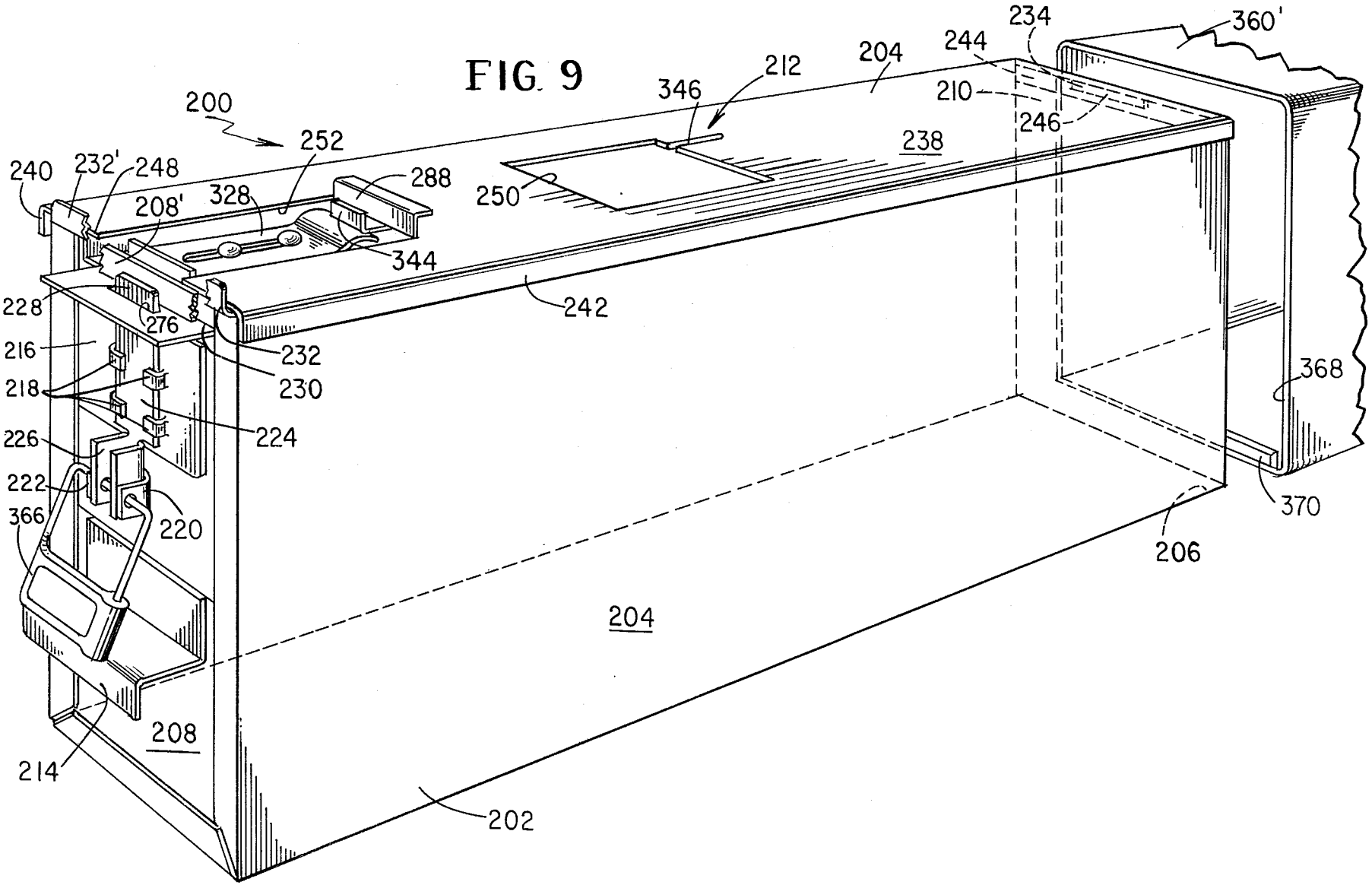
FIG. 9 is a perspective view of a locked coin box having a modified cover of the invention installed thereupon and about to be installed within a vending machine.
Figure 10:
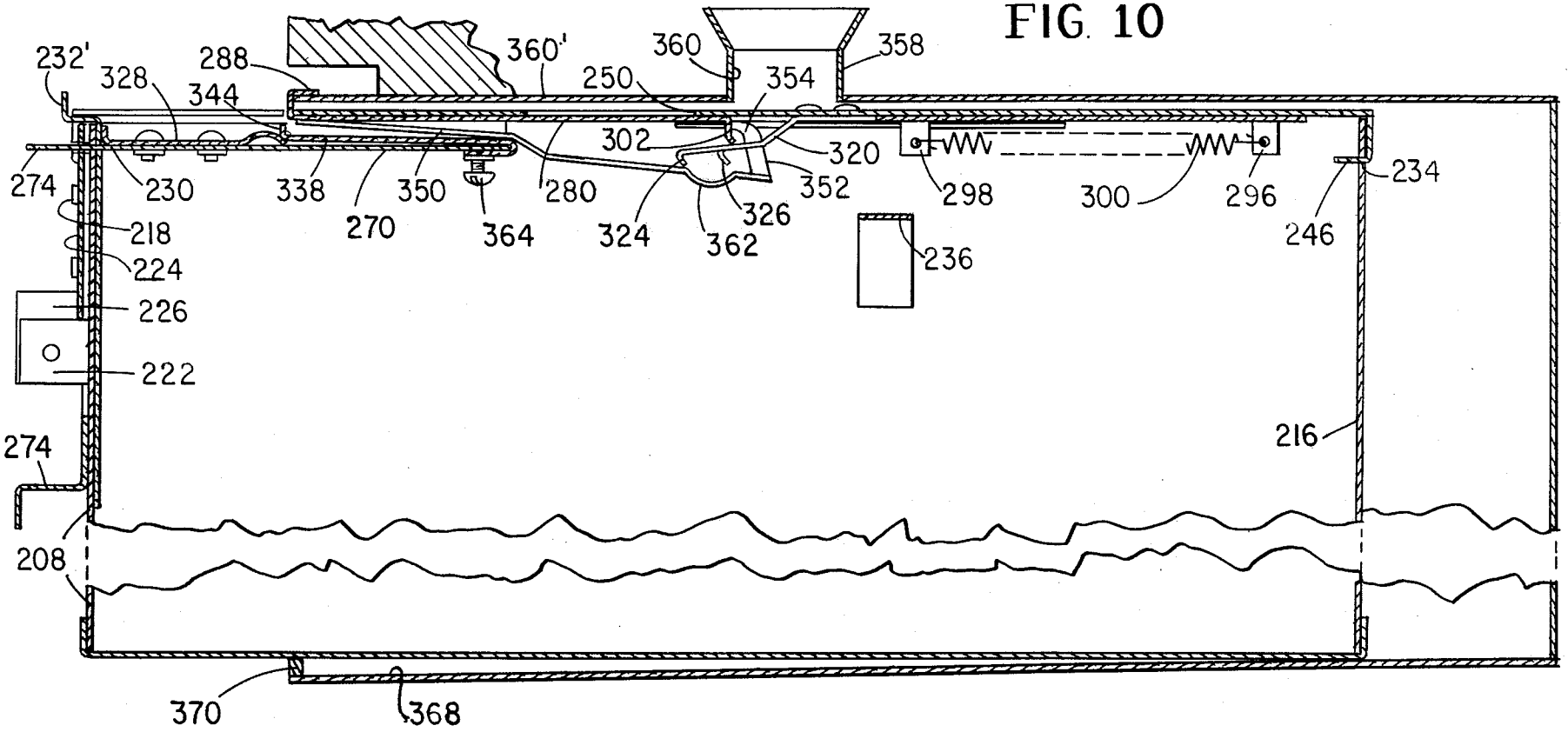
FIG. 10 is a sectional elevational view taken through the locked covered coin box of FIG. 9 during installation.
Figure 11:
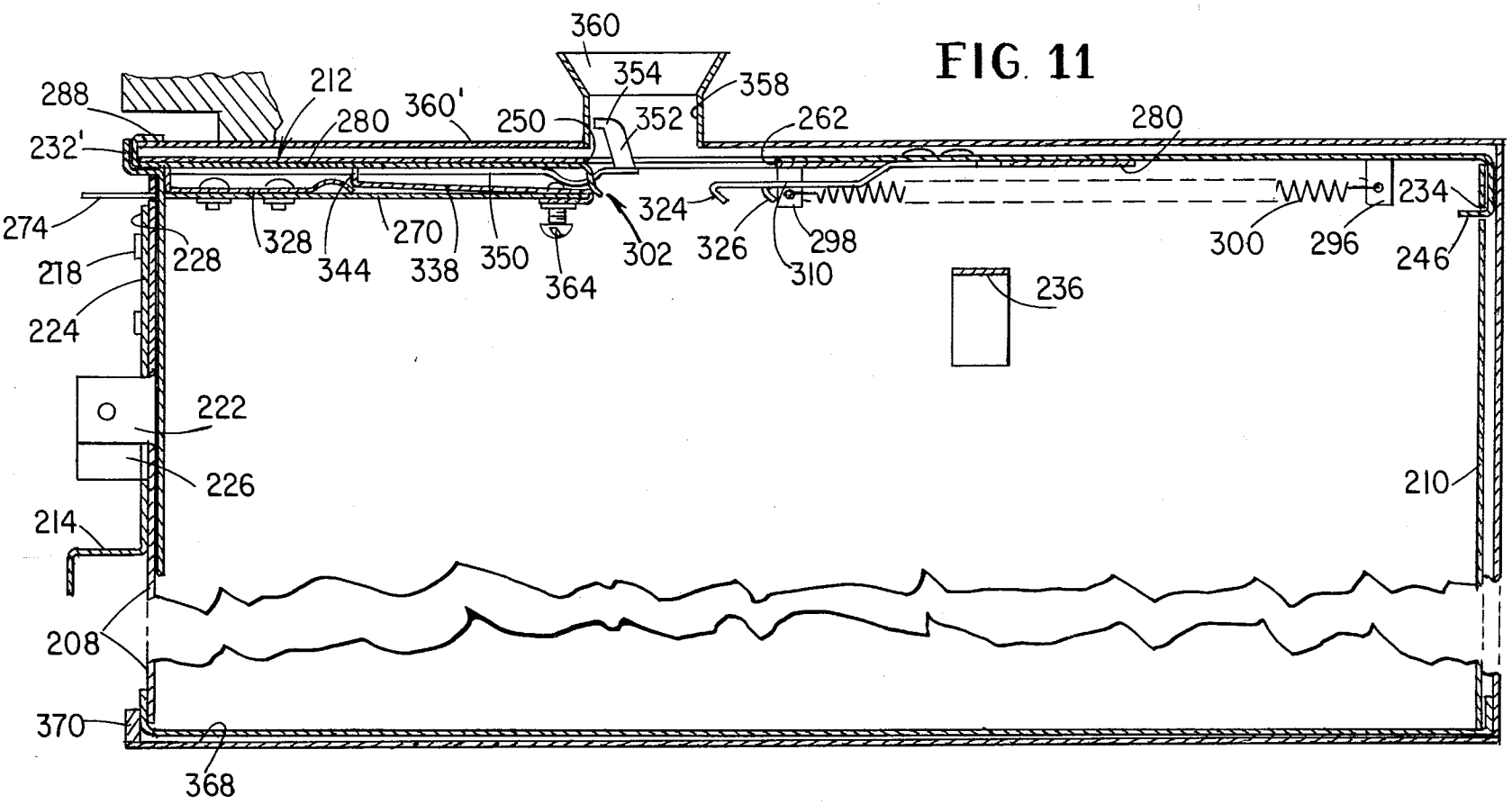
FIG. 11 is a sectional elevational view similar to FIG. 10 but with the locked covered coin box viewed subsequent to installation, the coin receiving window illustrated in fully open condition.
Figure 12:
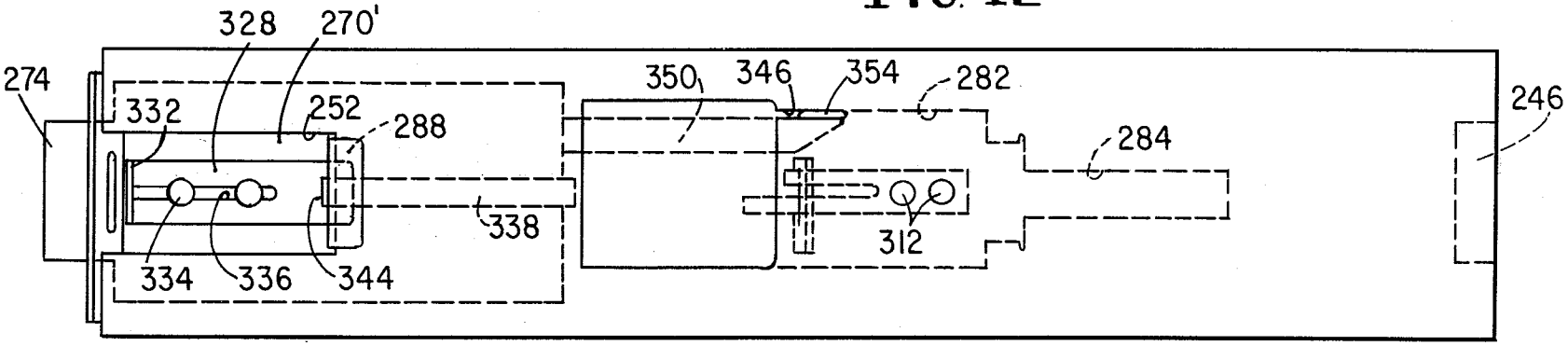
FIG. 12 is a top plan view of the cover illustrated in FIG. 9.
Figure 13:
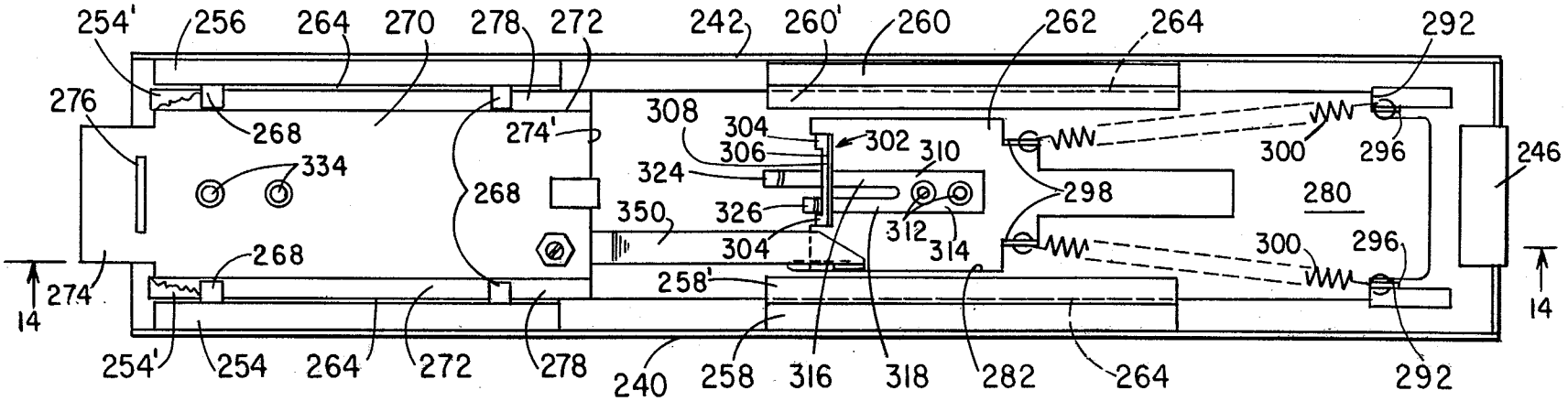
FIG. 13 is a bottom view of the cover illustrated in FIG. 9.

Referring now to FIGS. 9 to 21, a modified embodiment of the invention is illustrated as installed on a coin box and is designated generally by reference character 200 in FIG. 9, the assembly comprising a rectangular open-topped box 202 of rectangular configuration having side walls 204, bottom wall 206, front and rear walls 208 and 210 with the cover designated by reference character 212.

The front wall 208 carries a flanged pull member 214 and a plate 216 also being secured thereto. The plate 216 carries tab pairs 218. A U-shaped plate 220 is secured to front wall 208 between pull member 214 and plate 216 so that its pair of upstanding parallel apertured ears 222 are arranged substantially normal to wall 208. A slide member 224 including a pair of upstanding parallel apertured end ears 226 slidably is engaged in the track defined by the tab pairs 218. The spacing between the ears 222 is selected so that the ears 222 are slidable therebetween.

The slide member 224 has an extension 228 along the edge opposite the ear pairs 222. A transverse slot 230 is formed in front wall 208 between the plate 216 and the upper edge 208' of the front wall 208. A right angle flange 230 is provided along the upper edge 208' of the front wall, the free leg 232' thereof being oriented parallel to front wall 208. The rear wall 210 of box 202 has a transverse slot 234 formed therein. A transverse brace 236 (FIG. 10) is positioned interior of the box bridging the side walls 204 and secured thereto to maintain the dimensions and stability of the box.

The cover 212 includes a top wall 238, opposite side flanges 240 and 242 and end flange 244. End flange 244 has a right angle flange 246 extending toward the front edge 248 of the cover 212, in a plane parallel to top wall 238. A window 250 is formed by virtue of a cutout made in top wall 238 at a location selected so that the window 250 will be in alignment with the bottom end of the coin delivery chute of the coin operated machine when the coin box 200 is installed fully and operationally.

A second cutout 252 is formed in top wall 238 opening to the front edge 248 thereof. Two pair of generally flat flanged rails 254, 256 and 258,260 are secured permanently to the undersurface 262, (hereinafter referred to as the floor 262 of the channel defined by flanges 240,244) of wall 238 and alongside said flanges. Each of said rails 254, 256, 258 and 260 includes a parallel flange 254', 256', 258' and 260' respectively arranged in a plane parallel to the rails but above the plane thereof, being connected thereto by bends 264, said flanges 254', 256', 258' and 260' defining a track 266. Rails 254 and 256 are arranged adjacent to window 250 but on the rearward portion of floor 262. Two pair of crimpable or bendable tabs 268 are formed out of each flange 254' and 256', each pair being located spaced from the opposite ends of said flanges.

A second channeled member 270 is engaged within the cover 212. Channel member 270 has side flanges 272 and an end extension 274 having a transverse slot 276 formed therein. The side flanges 272 each include parallel angle flanges 278. The flanges 278 are seated upon flanges 254' and 256'; the tab pairs 268 adapted to be crimpled or bent over said flanges to hold the member 270 secured against movement.

A slide 280 formed of an elongate strip of metal is arranged between flanges 240, 244 of cover 212. The slide 280 is capable of movement to the right and left in the track defined by the flange portions 254', 256', 258' and 260'. The slide 280 has a relatively wide cutout 282 and a narrower cutout 284 opening thereto, the imperforate portion serving to cover the window in normal condition of the slide. Upstanding pull flange 288 is provided integral therewith at one end 290 of the slide 280. A pair of corner notches 292 are formed at the opposite end 294 of the slide 280. A pair of upstanding apertured lugs 296 are secured to the floor 264 and a second pair of apertured upstanding lugs 298 are formed on slide 280 alongside the entrance to the narrow cutout 282. Expansion springs 300 are secured to the respective apertured lugs 296 and 298 by opposite ends thereof. Thus, the slide 280 is biased normally toward the right-hand end of the cover 212, any movement of the slide 280 leftward to uncover window 250 being against the bias of said springs 300.

An upstanding transverse bridge or loop 302 is formed integral with the slide 280 adjacent the cutout 282. The loop 302 is formed of a pair of upstanding supports 304 and a bar 306 bridging the top of same and defining a passage 308.

A flat spring 310 is fastened to the floor 262 of the cover by rivets 312 or by welding. Spring 310 has a flat end 314 and a pair of generally flat spring arms 316 and 318 connected to the flat end 314 by bends 320 and 322. Each of the spring arms 316 and 318 have return bent hook portions or claws 324 and 326. The longer arm, 316, and the shorter arm, 318, normally extend in a plane parallel to the floor 262 of cover 212 but are spaced from said floor 262 a distance sufficient to assure that the claws 324, 326 may be intercepted by the bar 306 of loop 302 so as to guide said spring arms 316 and 318 through the loop 302 (i.e., passage 308). Once the bar 306 of loop 302 passes the claws 324 and 326, the spring arms 316 and 318 return to their normal condition aligned with the passage 308 extending parallel to the floor 262. Leftward passage of the slide 280 is therefore barred by the engagement of the claws 324 and 326 with the bar 306 of loop 302, should an attempt be made to move the slide 280 to the left after the slide 280 had been moved to drop arms 316, 318.

Figure 21A:
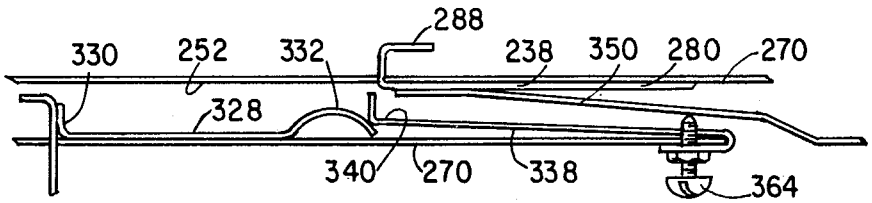
FIG. 21A is a fragmentary detail illustrating the safety latch means employed during carrying of the locked coin box of FIGS. 9 to 20 shown just prior to installation.
Figure 21B:
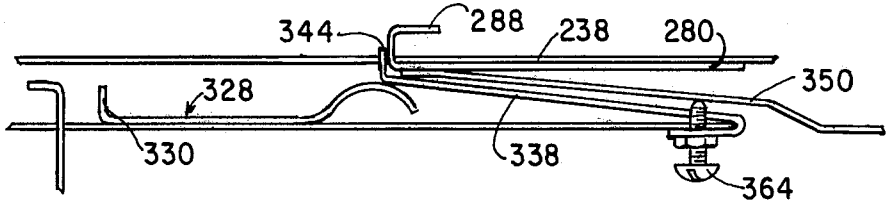
FIG. 21B illustrates the condition of said safety latch during carrying of the locked box.

With particular reference to FIGS. 21A and 21B, a safety slide 328 having a right angle bend 330 at one end and an arcuate portion 332 at its opposite end, is secured to the floor 270' between side flanges 272 by a pair of spaced rivets 334 passing through elongate slot 336 formed between side flanges 272 of member 270. The safety slide 328 is movable between a pair of positions defined by the limits of the pair of rivets 334 engaging the ends of slot 336.

A flat spring 338 is secured to the end 274' of channel member 270, the free end 340 terminating in upstanding flange 344 and being biased toward the floor 270' of channel member 270. When the slide 328 is disposed at its most leftward position, the arcuate portion 332 is arranged to engage the free end 340 of the spring 338. When the slide 328 is moved to its second, most rightward position, the free end 340 of the spring 338 is cammed away from the floor 270' to force the bend 344 into the end notch or cutout 252 of top wall 238 of cover 212, so as to block movement of the pull member 288 of slide 280 to the left. As will be appreciated, this enables carrying of the locked box when the same is in condition for installation into the enclosure without tripping the set spring catch mechanism.

The cover 212 carries a narrow longitudinal slot 346 running parallel to the side flanges 240, 244 thereof and opening to window 250 at the rearward or right side thereof. One end 348 of leaf spring 350 is secured to the slide 280 and includes a bent portion 352 terminating in a hooked detent 354.

As the slide 280 is moved toward the left, the bent portion 352 is cammed against its normal bias by the channel member 270 and is directed toward the cover 212. The detent 354 then is caused to pass through slot 346 so that its hooked end 356 engages wall 358 of the delivery end 360 of the coin chute. The detent 354 is cammed by the enclosure wall 360' out of interferent relation with the passage of the box into the recess of the machine until the coin chute is reached.

If prior to installation an attempt is made to tamper with the window or slide, or remove the coin box with the window 250 uncovered, withdrawal of the box 200 in such condition is blocked. Once an attempt has been made to insert the box 200, as well as the covered coin bag 10, into the receiving means in the coin controlled machine, entry must continue to completion since withdrawal even at an early stage will release the slide and cover the window. Also, the detent will be disposed through slot 246 and placed into blocking condition or withdrawal.

If there is no tampering during the installation of the coin box into the enclosure of the machine, the hooked end 356 of detent 354 passes fully through the window into the delivery chute as the window is being uncovered by movement of the slide 280 to the left. If once the window 250 is partially or fully uncovered, an attempt be made to remove the coin box 200 while the window 250 is open, the hooked end 354 of spring 350 will engage the chute wall 358 to prevent removal. An arch or rib 362 can be provided on the spring member 350 to provide added strength thereto. Tension on the spring 350 can be adjusted by adjustment of screw 364 mounted to channel member 270 near end 274' thereof.

The spring catch defined by the pair of spring arms 316 and 318 can be set or cocked into condition for installation of the locked box 200 into the enclosure by pulling the slide 270 against the bias of springs 300 while simultaneously depressing said spring arms 316 and 318 to enable the claws 324 and 326 thereof to clear the bar 306 and then releasing the slide 270 while lifting said spring arms 316 and 318 as the bar 306 is passed. This can be performed manually by an authorized operator. Now the arms 316 and 318 ride on the bar 306 of loop 302. This process is followed during resetting or "cocking" of said spring catch.

With the arms 316 and 318 so disposed, the cover 212 can be installed upon an empty coin box 202 by sliding extension 274 through the slot 230 of the front wall 208 and the flange 246 through the slot 234 of the rear wall 210. The slide 224 is moved upward to allow end portion 228 thereof to pass through slot 276 of channel member 270. The safety slide 328 is moved fully to the right, so as to raise the flange 344 blocking the pull 288 of slide 280. A tab, lock or other security means 366 then may be passed through the aligned apertures of ears 222 and 226. The locked or secured coin box and cover 200 is ready for introduction into the prefabricated enclosure of the coin operated machine with which it is intended for service, represented in phantom in FIG. 9, after moving slide 328 leftward.

When the thus prepared fresh coin box 200 is ready to be installed into the enclosure of the machine, the serviceman simply releases the safety slide 328 by moving the slide 328 to the left. He slides the box 200 into the enclosure 368 until the outer upper edge of the enclosure engages the pull 288 of slide 280. The box 200 is canted slightly in view of ledge 370 at the bottom edge of the enclosure 368, lifting same over the ledge 370. As the covered box 200 is forced further into the enclosure 368, the slide 280 is moved to the left, uncovering the window 250. First, the shorter spring arm 318 drops off the bar 306 of loop 302 and thereafter, the longer spring arm 316 drops off the bar 306. The detent 354 is forced through the slot 346 and then enters the window 250. Once the detent 354 is within the slot 346, withdrawal of the locked box assembly 200 is prevented by the coin chute. This occurs even if the spring arms 316,318 have not been released from the bar 306. The box cannot be withdrawn from the enclosure 368 of the machine unless the detent 354 fully is withdrawn from the slot 346 and is below the level of wall 238 of cover 212. This event cannot occur unless the window 250 is fully covered.

Any attempt to tamper with the cover 212 to gain access to the box 200 by gaining access through window 250 is not possible without leaving visible evidence of such tampering. The claws 324, 326 of spring arms 316 and 318 prevent movement of the slide 280 to the left. If the spring 318 malfunctions, the longer arm 316 is engaged by the bar 306. If tape was placed across slot 346 to prevent the detent from passing therethrough, or onto the spring 350 to prevent its operation, one or both claws 324, 326 would nevertheless prevent movement of the slide 280 once the window 250 has been uncovered.

In order to remove the loaded box 200 from the enclosure, one simply lifts the box 200 from engagement with ledge 370. The pull 288 is released and, due to springs 310, the slide 280 snaps back to its normal condition, closing off the window 250 and with the spring arms 216, 218 engaged through the loop 302. Now, access to the interior of the loaded locked box 200 cannot be gained without severing the locking tab 372 or operating the other independent lock which may have been provided.

Reference is made to the FIGS. 14 through 20 so that the various stages of operation of the spring catch means represented by spring 310 and loop formation 302 can be followed, and likewise, the operation of the detent means as represented by spring 350 with hook formation 354 can be viewed.

Figure 14:
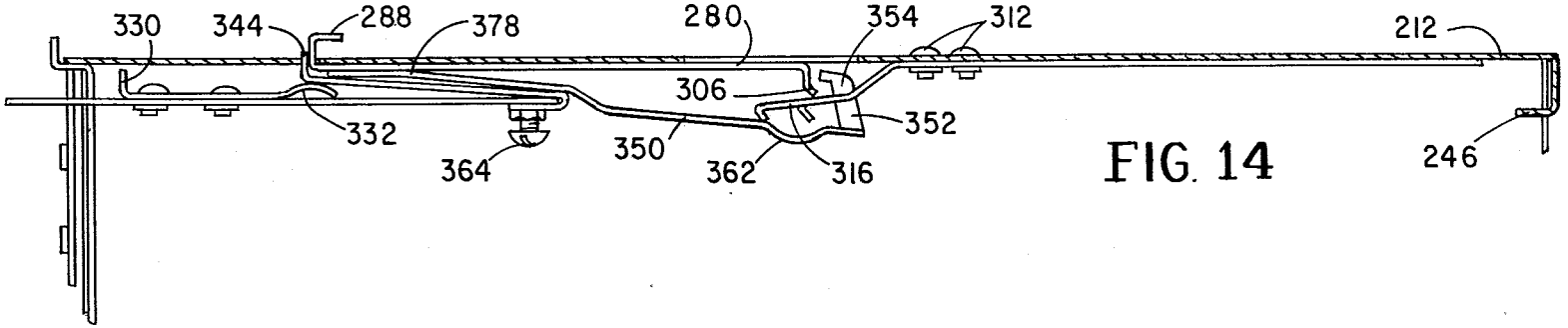
FIG. 14 is a fragmentary section taken along line 14—14 of FIG. 9 and in the direction indicated by the arrows.

In FIG. 14, the cover 212 is illustrated in condition just prior to installation into the enclosure 360' and with the safety latch 328 still in locked condition, as the box 200 is to be carried by the serviceman.

The springs 316, 318 ride portion 306 of loop formation 302. The detent is relaxed, the spring 350 being disposed normally away from the window 250.

Figure 15:
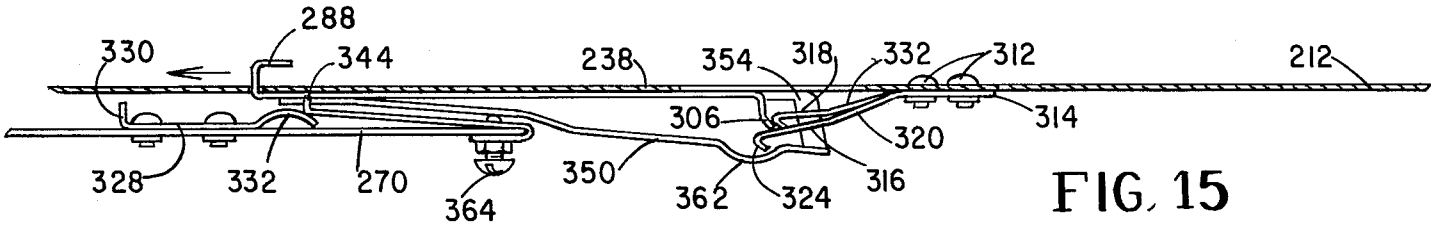
FIG. 15 is a fragmentary view of a portion of FIG. 14 illustrating the first stage of a modified protective catch means during installation of the coin box.

In FIG. 15, the covered box 200 is introduced into the enclosure or recess 360' with the safety catch retracted, and the pusher 288 is engaged by the leading edge of the enclosure 360' to move the slide 280 slightly to the left against the bias of springs 300. Initially, the shorter spring 318 drops off the bar 306 and the detent 354 appears part way in slot 346. Attempted withdrawal of the box 200 would cause claw 326 to pass through passage 308 of loop formation 302. Now if the slide were released, the claw would be in condition to engage the bar 306.

Figure 16:
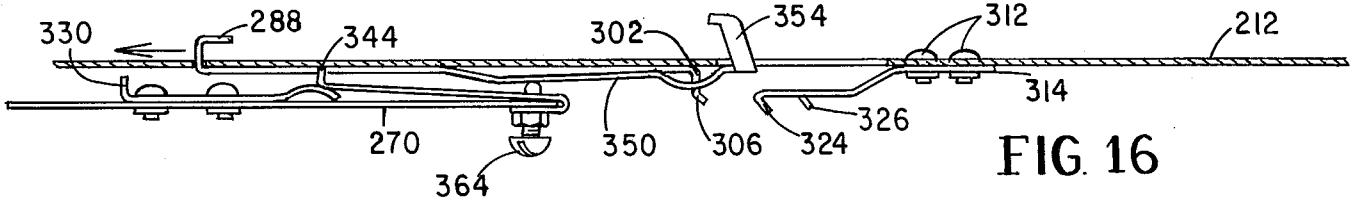
FIG. 16 is similar to FIG. 15 illustrating a second stage of said modified protective catch means during installation, the window partially open.
Figure 17:
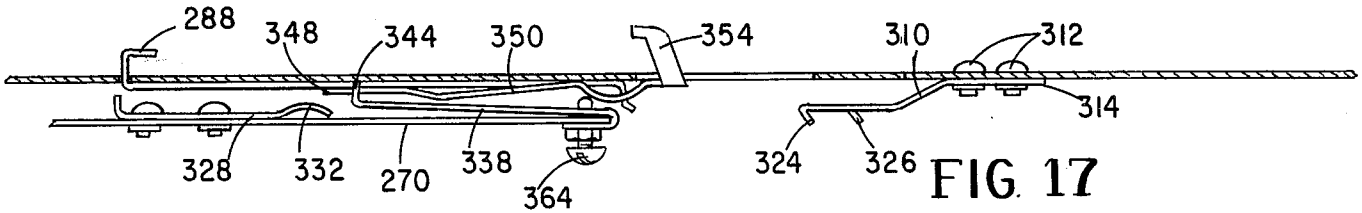
FIG. 17 is similar to FIG. 15 illustrating the condition of said modified protective catch means, the installation being completed.

In FIG. 16, the spring catch means is illustrated at a further stage during the installation of the box 200. Both spring arms 216, 218 have dropped off bar 106. The detent 354 has been forced into window 250. The claws 324 and 326 are aligned with the passage 308 of loop formation 302. Now, when the slide 280 is released, as would occur the instant box 200 is lifted above ledge 370, the claws 324,326 would pass beneath bar 306 through passage 308 locking the slide 280 against further movement to the left. The detent 354 has passed through window 250 and would engage the wall 358 of chute 360. FIG. 17 illustrates the fully installed condition of the cover 212.

Figure 18:
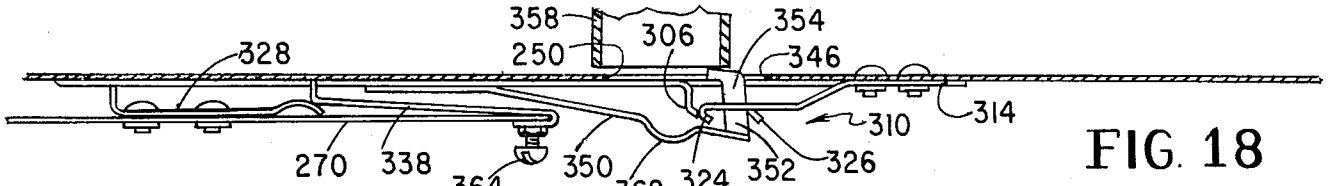
FIG. 18 is a view similar to FIGS. 15 to 17 but illustrating the modified protective catch means during withdrawal of the coin box from the enclosure.

FIG. 18 illustrates the first stage in withdrawing the box 200 from the enclosure during servicing. The detent spring 350 is freed from the nut 364 by movement of the box 200 causing the hook formation 354 to descend from the window 250. The claw 324 of longer spring arm 316 engages bar 306 of loop formation 302, claw 324 is aligned to pass through passage 308 thereof.

Figure 19:
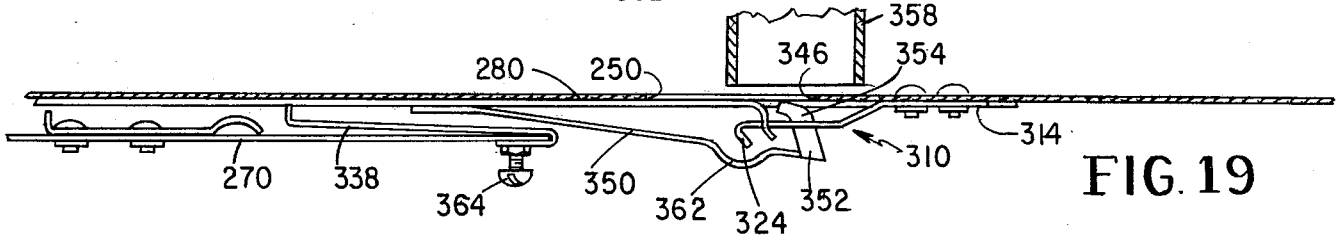
FIG. 19 is a view similar to FIG. 10 illustrating a further stage of the modified protective catch means during withdrawal.

In FIG. 19, the claw 324 has passed through the passage 308.

Figure 20:
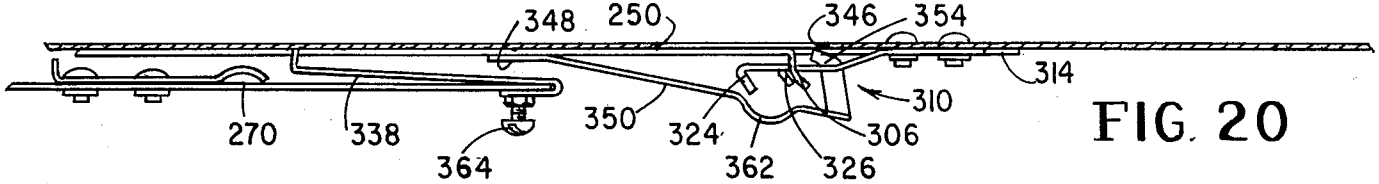
FIG. 20 is a view similar to FIGS. 18 and 19 but showing the modified protective catch means subsequent to withdrawal.

FIG. 20 illustrates the last stage, the slide 280 having been fully returned to normal condition where claws 224 or 226 have passed through passage 308 and the detent just prior to being released in toto so as to permit the detent 354 to withdraw into the cover and out of interferent relationship with withdrawal of box 200 from the recess.

It should be understood that the detent means, represented in FIGS. 1 to 8 by pivotally mounted detent 126 and cam defined by slot 120 and follower 134, and in FIGS. 9 to 20 by spring 350 can be spring biased or cam biased with substantially equal effect. Likewise, one spring arm or more can be employed to define the spring catch means of the invention.

It should be appreciated that many variations of constructional details are contemplated without departing from the spirit and scope of the invention as defined in the appended claims.

I claim:

1. A cover assembly adapted to be locked onto a coin-receptacle capable of being inserted into a preformed recess of a coin-controlled machine of the type that has an interior coin chute having a delivery end opening to the recess; comprising, a top wall having a window adapted to be aligned with the coin chute when the cover is engaged on the coin receptacle and together therewith installed within the recess, slide means seated for slidable movement beneath the top wall to cover and uncover the window, first spring means secured to the cover and to said slide means for biasing the slide means to a condition whereat the window is covered and spring catch means coupled between the slide means and said cover operable between a first condition permitting movement of said slide means against the bias of said first spring means and a second condition whereat to prevent movement of said slide means against said spring bias and detent means within said cover and operable with the movement of said slide means, said detent means being disposed normally away from said window, said slide means operable to drive said detent means positively into said window when said slide means is manipulated against the bias of said first spring means partially or fully to uncover said window, whereby withdrawal of said coin-receptacle from said recess is prevented except when the window is fully covered.

2. The cover assembly as claimed in claim 1 in which said detent means are connected to said slide means.

3. The cover assembly as claimed in claim 1 in which said detent means are biased normally away from said window when the window is covered.

4. The cover assembly as claimed in claim 1 wherein said spring catch means comprise at least one spring arm, means for securing said spring arm to one of said cover and said slide means, said spring arm having claw means at the terminal end thereof, loop means carried by the other one of said cover and said slide means, said loop means arranged to be intercepted by said spring arm when the slide means is operated, said spring arm riding on said loop in one condition of said slide means when the window is closed and arranged to pass through said loop when the slide means is returned to the normal condition subsequent to uncovering of the window, said claw means then being engageable with said loop to prevent subsequent movement of said slide means whereby to maintain the window thereafter in covered condition.

5. The cover assembly as claimed in claim 4 wherein said spring catch means includes a second spring arm longer than the first and also having claw means formed at the free end thereof, said second spring arm also arranged to be intercepted by said loop but earlier than the first spring arm and to be engaged within the interior of the loop prior to said first spring arm, being so engaged.

6. The cover assembly as claimed in claim 4 in which lever means are coupled to said spring catch means for resetting the spring arm thereof disposed to ride said loop subsequent to uncovering of said window.

7. A cover assembly adapted to be locked onto a coin-receptacle capable of being inserted into a preformed recess of a coin-controlled machine of the type that has an interior coin chute having a delivery end opening to the recess; comprising, a top wall having a window adapted to be aligned with the coin chute when the cover is engaged on the coin receptacle and together therewith installed within the recess, slide means seated for slidable movement beneath the top wall to cover and uncover the window, first spring means secured to the cover and to said slide means for biasing the slide means to a condition whereat the window is covered and spring catch means coupled between the slide means and said cover operable between a first condition permitting movement of said slide means against the bias of said first spring means and a second condition whereat to prevent movement of said slide means against said spring bias and said coin-receptacle comprises a flexible coin receiving bag, a channeled plate having a rear wall, means securing said bag to said wall, a pair of flanged side walls and an open end, said cover being slidable through the open end of said plate to engage the rear wall thereof and said channeled plate having an opening formed therein adapted to be aligned with said window when the cover is installed therein, means securing said coin bag over the opening in said channeled plate and means secured to said slide means for driving same against the bias of said first spring means.

8. The cover assembly as claimed in claim 7 wherein swivel coupling means are provided to secure said bag to said channeled plate.

9. The cover assembly as claimed in claim 7 and retainer means on one of said channeled plate and cover to retain same in assembly while said window is uncovered.

10. The cover assembly as claimed in claim 7 and pusher means installed within said recess, said pusher means arranged to pass through the said opening in said rear wall of the plate and engage said driving means to uncover said window as the cover assembly is introduced into said recess.

11. The cover assembly as claimed in claim 1 in which said detent means are spring biased to urge same from said window when same is covered.

12. The cover assembly as claimed in claim 1 in which said detent means comprise cam means effective to withdraw said detent from said window when the window is covered by said slide means.

13. The cover assembly as claimed in claim 1 in which said detent means comprises an elongate arm pivotally coupled to said slide means, said arm having a prong formation at the terminal end thereof and means biasing said prong away from said window during normal condition of said slide means, manipulation of said slide means against its normal bias of said first spring means serving to drive said prong formation into the window to assume an interferent condition relative to removal of said cover assembly from the recess whenever the window is uncovered.

14. The cover assembly as claimed in claim 13 in which said means biasing said prong comprise cam means arranged within said cover and follower means secured to said prong.

15. The cover assembly as claimed in claim 13 and pusher means are installed within the enclosure, said pusher means adapted to engage said drive means for operating the slide means.

16. The cover assembly as claimed in claim 7 wherein a coin funnel is secured interior of said enclosure and in communication with the delivery end of the coin chute, said coin funnel having a bottom opening, a channeled member secured to said funnel in communication with said bottom opening, said channeled member having a rear end wall and having means defining a track therein for receiving said cover slidably therein, pusher means secured on said rear end wall interior of said channeled member and arranged to engage said driving means for said slide means to uncover the window when the window is aligned with said funnel opening.

17. The cover assembly as claimed in claim 16 wherein detent means are coupled to said slide means, said detent means being biased normally away from said window but said slide means being operable to drive said detent means into the window whenever said slide means is manipulated against the bias of said first spring means and said window is partially and fully uncovered, whereby withdrawal of said receptacle from said recess is prevented except when the window fully is covered.

18. The cover assembly as claimed in claim 17 in which said detent means are spring biased.

19. The cover assembly as claimed in claim 17 wherein said detent means is cammed out of said window when said slide means is returned to its normal condition with the window covered.

20. The cover assembly as claimed in claim 16 wherein said spring catch means comprise at least one spring arm, means for securing said spring arm to one of said cover and said slide means, said spring arm having claw means at the terminal end thereof, loop means carried by the other one of said cover and said slide means, said loop means arranged to be intercepted by said spring arm when the slide means is operated, said spring arm riding on said loop in one condition of said slide means when the window is closed and arranged to pass through said loop when the slide means is returned to the normal condition subsequent to uncovering of the window, said claw means then being engageable with said loop to prevent subsequent movement of said slide means whereby to maintain the window thereafter in covered condition.

21. The cover assembly as claimed in claim 7 wherein said spring catch means comprise at least one spring arm, means for securing said spring arm to one of said cover and said slide means, said spring arm having claw means at the terminal end thereof, loop means carried by the other one of said cover and said slide means, said loop means arranged to be intercepted by said spring arm when the slide means is operated, said spring arm riding on said loop in one condition of said slide means when the window is closed and arranged to pass through said loop when the slide means is returned to the normal condition subsequent to uncovering of the window, said claw means then being engageable with said loop to prevent subsequent movement of said slide means whereby to maintain the window thereafter in covered condition.

22. The cover assembly as claimed in claim 17 wherein said spring catch means comprise at least one spring arm, means for securing said spring arm to one of said cover and said slide means, said slide arm having claw means at the terminal end thereof, loop means carried by the other one of said cover and said slide means, said loop means arranged to be intercepted by said spring arm when the slide means is operated, said spring arm riding on said loop in one condition of said slide means when the window is closed and arranged to pass through said loop when the slide means is returned to the normal condition subsequent to uncovering of the window, said claw means then being engageable with said loop to prevent subsequent movement of said slide means whereby to maintain the window thereafter in covered condition.

23. The cover assembly as claimed in claim 22 in which lever means are coupled to said spring catch means for resetting the spring arm thereof disposed to ride said loop subsequent to uncovering of said window.

* * * * *